US010086986B2

(12) United States Patent
Buck

(10) Patent No.: US 10,086,986 B2
(45) Date of Patent: Oct. 2, 2018

(54) FOOD CONTAINER WITH SEAL-ON COVER

(71) Applicant: SNACKTOPS, INC., Carlsbad, CA (US)

(72) Inventor: Ronald Mark Buck, Encinitas, CA (US)

(73) Assignee: SNACKTOPS, INC., Carlsbad, CA (US)

( * ) Notice: Subject to any disclaimer, the term of this patent is extended or adjusted under 35 U.S.C. 154(b) by 0 days.

(21) Appl. No.: 15/287,697

(22) Filed: Oct. 6, 2016

(65) Prior Publication Data

US 2017/0101236 A1 Apr. 13, 2017

Related U.S. Application Data

(60) Provisional application No. 62/239,483, filed on Oct. 9, 2015.

(51) Int. Cl.
*B65D 17/28* (2006.01)
*B65D 17/347* (2006.01)
(Continued)

(52) U.S. Cl.
CPC ..... *B65D 53/00* (2013.01); *A47G 21/18* (2013.01); *B65D 25/42* (2013.01); *B65D 43/02* (2013.01);
(Continued)

(58) Field of Classification Search
CPC ..... B65D 53/00; B65D 25/42; B65D 43/02; B65D 51/28; B65D 77/204; B65D 77/32;
(Continued)

(56) References Cited

U.S. PATENT DOCUMENTS 3,701,454 A 10/1972 Thorp
4,921,137 A * 5/1990 Heijenga ..... B65D 75/5811 222/107
(Continued)

FOREIGN PATENT DOCUMENTS

WO 2004045979 A1 6/2004
WO 2006089750 A1 8/2006

OTHER PUBLICATIONS

International Search Report and Written Opinion issued in PCT/US2016/055848 dated Dec. 15, 2016 (10 pages).
(Continued)

*Primary Examiner* — J. Gregory Pickett
*Assistant Examiner* — Niki M Eloshway
(74) *Attorney, Agent, or Firm* — Manuel de la Cerra

(57) ABSTRACT

A food container is disclosed that includes a food compartment and a seal-on cover. The food compartment has an outer rim that circumscribes a volume. The food compartment outer rim has tear tab guides that extend outward from the rim. The seal-on cover has a peripheral edge with two portions, the first portion is connected to the rim and the second portion is not connected to the rim and extends past the outer rim forming an overhang. The extended tear tab guides are located adjacent to the overhang and direct the user as to where the tear line begins at the overhang and extends to an opposite side of the peripheral edge. When a user pulls on the overhang, the seal-on cover tears along the tear line and exposes a portion of the volume.

19 Claims, 8 Drawing Sheets

(51) Int. Cl.

| | |
|---|---|
| ***B65D 53/00*** | (2006.01) |
| ***A47G 21/18*** | (2006.01) |
| ***B65D 25/42*** | (2006.01) |
| ***B65D 43/02*** | (2006.01) |
| ***B65D 51/28*** | (2006.01) |
| ***B65D 77/32*** | (2006.01) |
| ***B65D 77/20*** | (2006.01) |
| ***B65D 81/32*** | (2006.01) |
| *B65D 17/32* | (2006.01) |

(52) U.S. Cl.
CPC ..... *B65D 51/28* (2013.01); *B65D 77/204* (2013.01); *B65D 77/2056* (2013.01); *B65D 77/32* (2013.01); *B65D 81/3205* (2013.01); *B65D 2543/00833* (2013.01); *B65D 2577/205* (2013.01); *B65D 2577/2091* (2013.01)

(58) Field of Classification Search
CPC ..... B65D 81/3205; B65D 2543/00833; B65D 2543/2577; B65D 2543/205; B65D 2577/2091
USPC ..... 220/737, 270, 359.2, 266, 268; 7/737
See application file for complete search history.

(56) References Cited

U.S. PATENT DOCUMENTS 4,946,038 A * 8/1990 Eaton ..... B65D 77/206 206/528
5,529,224 A * 6/1996 Chan ..... B65D 75/58 222/107
5,839,609 A * 11/1998 Zakensberg ..... B65D 75/32 206/484
6,338,417 B1 * 1/2002 Ferraro ..... B65D 21/0228 206/217
6,648,140 B2 * 11/2003 Petricca ..... A45D 27/225 206/356
6,706,297 B1 3/2004 Toth et al.
7,004,322 B1 * 2/2006 Bartoli ..... B65D 75/5811 206/484
8,365,910 B2 * 2/2013 Valaie ..... A61L 2/26 206/363
8,911,807 B2 * 12/2014 Hinze ..... B65D 85/62 220/784
8,939,312 B1 1/2015 Buck
2006/0102630 A1 * 5/2006 Cassol ..... B65D 17/165 220/270
2013/0056463 A1 * 3/2013 Buck ..... A47G 19/065 220/23.83
2013/0119065 A1 * 5/2013 Buck ..... A47G 19/2205 220/523
2013/0228486 A1 * 9/2013 Buck ..... B65D 21/0238 206/459.1
2014/0069927 A1 * 3/2014 Willemsen ..... B65D 77/2052 220/359.2
2014/0106048 A1 * 4/2014 Harper ..... A23L 2/52 426/548
2015/0122673 A1 * 5/2015 Loumbroukos .... A47G 19/2205 206/217
2015/0203245 A1 7/2015 Gayer
2016/0114959 A1 * 4/2016 Strominger ..... B65D 1/265 220/23.86
2016/0159546 A1 * 6/2016 Cassidy ..... B65D 77/204 220/268
2016/0324371 A1 * 11/2016 Herrera, Jr. ..... A47J 47/02
2016/0368690 A1 * 12/2016 Yokoyama ..... B65D 77/003
2017/0096276 A1 * 4/2017 Zanarella ..... B65D 77/2056

OTHER PUBLICATIONS

International Preliminary Report on Patentability issued in PCT/US2016/055848 dated Apr. 19, 2018 (9 pages).

* cited by examiner

FOOD CONTAINER WITH SEAL-ON COVER

RELATED APPLICATIONS

This application claims priority to U.S. Patent Application 62/239,483 entitled "FOOD CONTAINER WITH PEEL OFF COVER" filed on Oct. 9, 2015, the contents of which are incorporate herein by reference.

This application is also related to U.S. Pat. No. 8,596,491 entitled "CUP LID WITH INTEGRATED CONTAINER" issued on Dec. 3, 2013; U.S. Pat. No. 8,695,845 entitled "TOP MOUNTING CAN CONTAINER" issued on Apr. 15, 2014; U.S. Pat. No. 8,381,935 entitled "CUP LID WITH INTEGRATED CONTAINER" issued on Feb. 26, 2013; U.S. Pat. No. 8,714,393 entitled "CUP LID WITH INTEGRATED CONTAINER" issued on May 6, 2014; U.S. Pat. No. 8,590,730 entitled "TOP MOUNTING CAN CONTAINER" issued on Nov. 26, 2013; U.S. Pat. No. 8,708,181 entitled "LID WITH INTEGRATED CONTAINER" issued on Apr. 29, 2014; U.S. Pat. No. 8,701,914 entitled "TWO-PART RECYCLABLE CUP" issued on Apr. 22, 2014; U.S. patent application Ser. No. 13/412,602 entitled "TOP MOUNTING BOTTLE CONTAINER" filed on Mar. 5, 2012; U.S. patent application Ser. No. 13/680,011 entitled "CUP LID WITH INTEGRATED CONTAINER" filed on Nov. 17, 2012; U.S. patent application Ser. No. 13/680,049 entitled "CUP LID WITH INTEGRATED CONTAINER" filed on Nov. 17, 2012; U.S. patent application Ser. No. 13/733,153 entitled "CUP LID WITH INTEGRATED CONTAINER" filed on Jan. 3, 2013; U.S. patent application Ser. No. 14/263,993 entitled "LID WITH INTEGRATED CONTAINER" filed on Apr. 28, 2014; U.S. patent application Ser. No. 14/269,016 entitled "A CONTAINER LID WITH ONE OR MORE CAVITIES" filed on May 2, 2014; U.S. patent application Ser. No. 14/274,576 entitled "A CONTAINER LID WITH A FOOD COMPARTMENT AND A SIP-HOLE" filed on May 9, 2014; U.S. patent application Ser. No. 14/313,907 entitled "A CONTAINER LID SYSTEM WITH A LID PORTION AND FOOD CONTAINER PORTION" filed on Jun. 24, 2014; and U.S. Patent Application Ser. No. 62/005,862 entitled "A CONTAINER LID SYSTEM WITH A LID PORTION AND FOOD CONTAINER PORTION" filed on May 30, 2014; U.S. patent application Ser. No. 29/500,266 entitled "BENDABLE DRINKING STRAW" filed on Aug. 22, 2014; U.S. Patent Application 62/038,209 entitled "BENDABLE SAFETY STRAW" filed on Aug. 16, 2014; U.S. Patent Application 62/105,256 entitled "BENDABLE SAFETY STRAW AND LIDS WITH FOOD COMPARTMENT" filed on Jan. 20, 2015; U.S. Patent Application 62/395,911 entitled "FOOD CONTAINERS, TRAYS AND LIDS" filed on Sep. 16, 2016; U.S. Patent Application 62/239,485 entitled "TRAY FOR FOOD CONTAINER" filed on Oct. 9, 2015, and U.S. patent application Ser. No. 14/986,703 entitled "CUP LID WITH INTEGRATED CONTAINER" filed on Jan. 3, 2016 all of which are by the same inventor of the present application. Each of these applications is incorporated herein by reference.

TECHNICAL FIELD

The present invention relates to food containers.

BACKGROUND OF THE INVENTION

The increased popularity of fast food establishments, coupled with the popularity for consumption of food on-the-go, has led to the need for more convenient food packaging.

Billions of disposable beverage containers are used every year. Often those containers are part of a larger meal, and current technology dictates placing a lid on the beverage container and packing the food in a separate and detached container. This may be satisfactory for a consumer seated at a table. However, when the consumer must eat on-the-go, use of the current technology is problematic. Consider, for example, a consumer who is drinking the beverage and would like to access to nuts, candy or another snack. The consumer must set aside a beverage, and then use one hand to hold the snack container and the other hand to access the snack. As shown in this example, current technology does not allow for convenient on-the-go eating.

To further aggravate this problem, gaining access to the snacks contained in the snack container is cumbersome and, often, inadvertently leads to spilling the entire contents of the snack container. For example, most people have opened a bag of chips or candy with too much force sending chips/candy flying in various directions.

What is therefore needed is food container that overcomes these shortcomings and fosters convenient on-the-go eating.

SUMMARY OF THE INVENTION

The following presents a simplified summary in order to provide a basic understanding of some aspects of the claimed subject matter. This summary is not an extensive overview and is not intended to identify key/critical elements or to delineate the scope of the claimed subject matter. Its purpose is to present some concepts in a simplified form as a prelude to the more detailed description that is presented later.

The present invention provides an elegant solution to the needs described above and provides numerous additional benefits and advantages as will be apparent to persons of skill in the art. A food container is disclosed that includes a food compartment and a seal-on cover. The food compartment has an outer rim that circumscribes a volume. Adjacent to the food compartment rim are one or more tear tab guides that extend outward from the rim and act as directional tear guides for removing a portion of the seal-on cover. The seal-on cover has a peripheral edge with two portions, where the first portion is connected to the rim and the second portion is not connected to the rim and extends past the outer rim forming an overhang. The extended tear tab guides located adjacent to the cover overhang inform the user where the tear line begins. The tear line begins at the overhang and extends to an opposite side of the peripheral edge. When a user pulls on the overhang, the seal-on lid cover tears along the tear line and exposes a portion of the food compartment volume.

In certain embodiments, the food compartment may be symmetrical about a food compartment symmetry axis. The food compartment may also include a food container coupling structure adapted to be detachably connected to a lid complementary coupling structure. The food compartment may have a pour spout. An edge of the extended tear tab guides adjacent to the seal-on cover overhang may be parallel to the tear line, assisting the user to tear the cover along the tear line.

In other embodiments, the seal-on cover may be symmetrical about a lid symmetry axis. The first portion of the peripheral edge may be connected to the rim by an adhesive or heat treatment. The tear tab guides also provide a larger surface area on which to adhere the seal-on cover, such that when a user pulls at the overhang of the seal-on cover, the cover is securely adhered to the tear tab guide, favoring a tear along the intended tear line. The seal-on cover may also have a notch adjacent to the overhang, and/or a score line, both of which favor a tear along the intended tear line.

In yet other embodiments, the peripheral edge of the seal-on cover may also have a third portion that is not connected to the rim and extends past the outer rim, forming a second overhang. The tear line extends from the overhang to the second overhang, and when a user pulls on the overhang or the second overhang, the seal-on cover tears along the intended tear line and exposes a portion of the food container volume.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

DETAILED DESCRIPTION

Figure 1A:
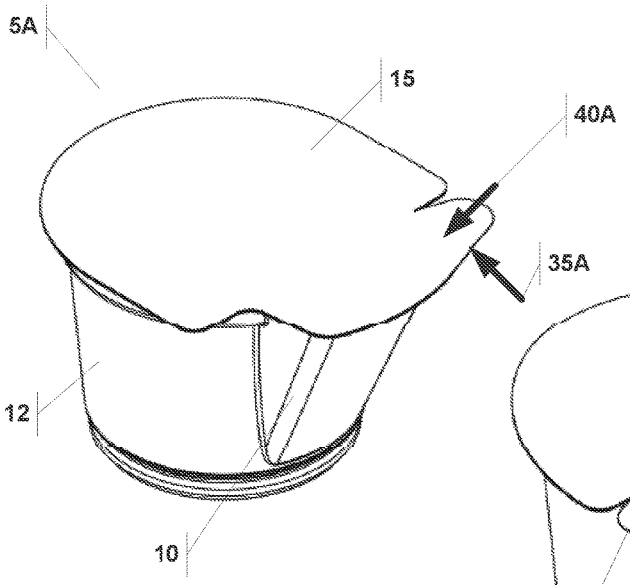
FIG. 1A illustrates a top perspective view of a first embodiment of a novel food container designed to guide a user into tearing a seal-on cover along an intended tear line.
Figure 1B:
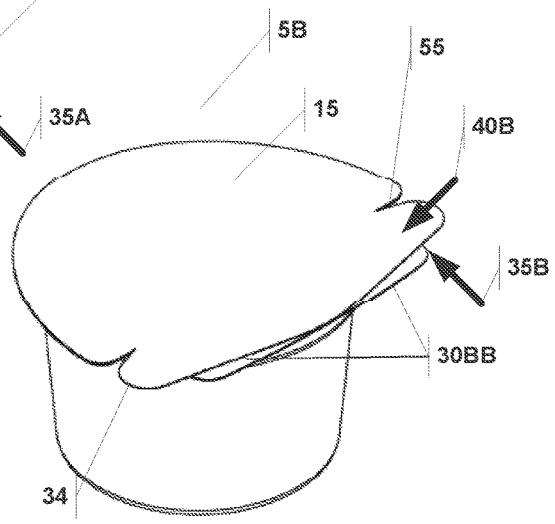
FIG. 1B illustrates a top perspective view of a second embodiment of a novel food container designed to guide a user into tearing a seal-on cover along an intended tear line.
Figure 1C:
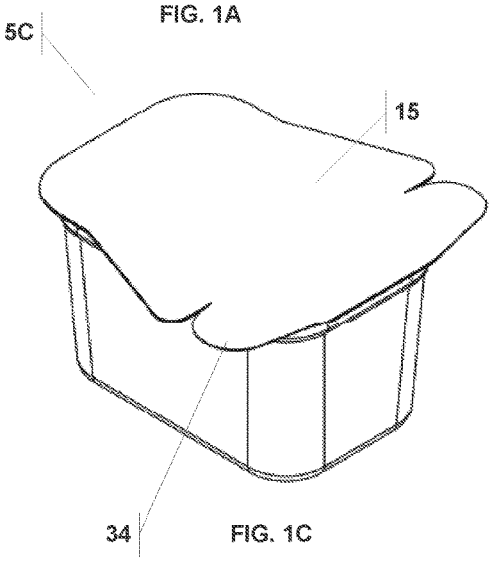
FIG. 1C illustrates a top perspective view of a third embodiment of a novel food container designed to guide a user into tearing a seal-on cover along an intended tear line.
Figure 1D:
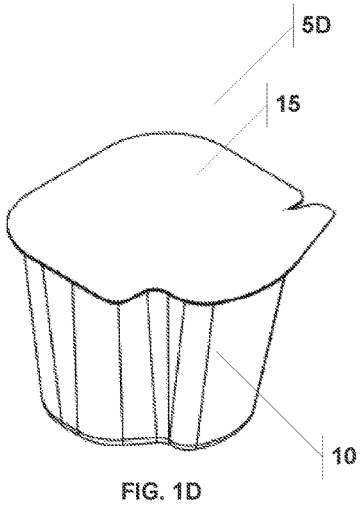
FIG. 1D illustrates a top perspective view of a fourth embodiment of a novel food container designed to guide a user into tearing a seal-on cover along an intended tear line.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all, in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with FIGS. 1-7 and is provided for ease of reference, where like reference numerals designate corresponding features throughout the specification and figures:

5A—first embodiment of a food container
5B—second embodiment of a food container
5C—third embodiment of a food container
5D—fourth embodiment of a food container
10—pour spout

12—food compartment
15—seal-on cover
17A—first portion of seal-on cover peripheral edge
17B—second portion of seal-on cover peripheral edge
20A—rim of food container (first embodiment)
20B—rim of food container (second embodiment)
22—food compartment volume
25A—cover overhang for tearing the seal-on cover (first embodiment)
25B—cover overhang for tearing the seal-on cover (second embodiment)
30A—extended tear tab guides that act as a direction guide for tearing a seal-on cover (first embodiment)
30B—extended tear tab guides that act as a direction guide for tearing a seal-on cover (second embodiment)
30BB—additional extended tear tab guides that act as direction guide for tearing a seal-on cover (second embodiment)
32—food compartment symmetry axis
33—cover symmetry axis
34—second cover overhang for tearing the seal-on cover (second and third embodiments)
35A—direction of tearing prevented by the extended tear tab guides (first embodiment)
35B—direction of tearing prevented by the extended tear tab guides (second embodiment)
40A—direction of tearing as guided by the extended tear tab guides (first embodiment)
40B—direction of tearing as guided by the extended tear tab guides (second embodiment)
45A—tear line (first embodiment)
45B—tear line (second embodiment)
45C—tear line (third embodiment)
45D—tear line (fourth embodiment)
50A—score line (first embodiment)
50B—score line (second embodiment)
50C—score line (third embodiment)
50D—score line (fourth embodiment)
55—cover notch
60—beverage container lid
65—beverage container
70—food container coupling structure
75—lid complementary coupling structure
80—beverage container coupling structure FIG. 1 illustrates several food containers (5A, 5B, 5C, 5D) comprised of a food compartment 12 and a seal-on cover 15. The seal-on cover 15, however, is not designed to be completely removed from the food compartment. This is advantageous for small food items that may be poured into the user's mouth, such as corn nuts, candies and nuts. If the entire seal-on cover 15 is removed, then the contents may spill when the user picks up the food container (5A, 5B, 5C, 5D) and pours the contents into his or her mouth. As can been seen, the food container (5A, 5D) may have a pour spout 10 formed into the food compartment 12 and a seal-on cover 15 as shown in FIGS. 1A and 1D, but the food container (5B and 5C) need not have such a spout 10, such as the embodiments in FIGS. 1B and 1C.

The food containers (5A, 5B, 5C, 5D) are designed to guide or direct the user to tear the seal-on cover 15 along an intended tear line so as to expose only a portion of the food compartment 12. In this way, the user may access the contents from the food compartment 12 through a pouring action without spilling the contents.

FIGS. 2A-2D correspond to the same embodiments that are shown in FIGS. 1A-1D respectively, but from an upward perspective view. Likewise, the FIGS. 3A-3D, 4A-4D, and 5B correspond to the same embodiments shown in FIGS. 1A-1D.

Figure 2A:
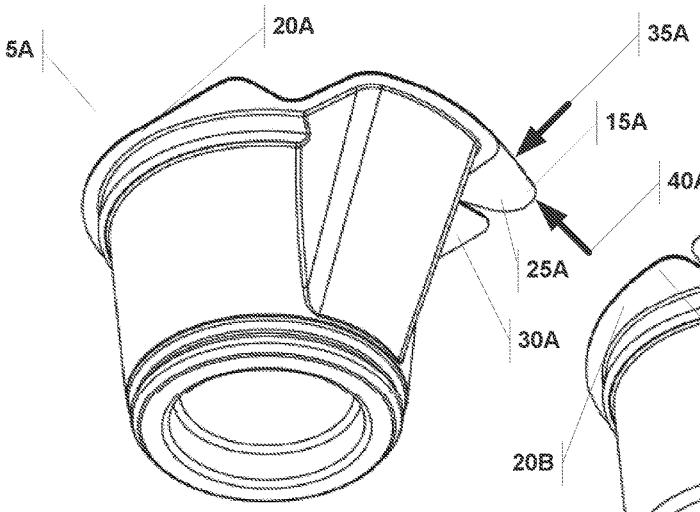
FIG. 2A illustrates a bottom perspective view of the first embodiment shown in FIG. 1A.
Figure 2B:
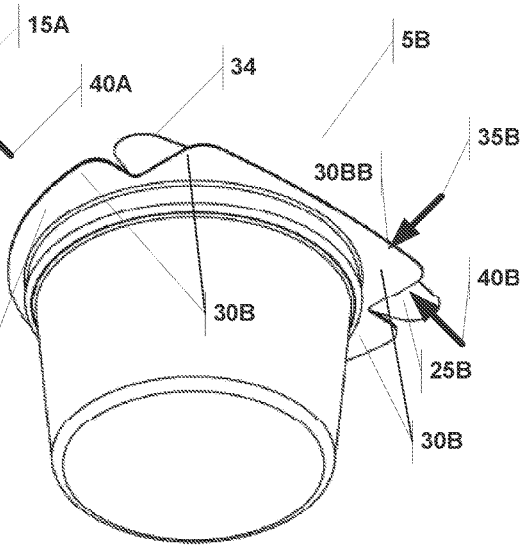
FIG. 2B illustrates a bottom perspective view of the second embodiment shown in FIG. 1B.
Figure 2C:
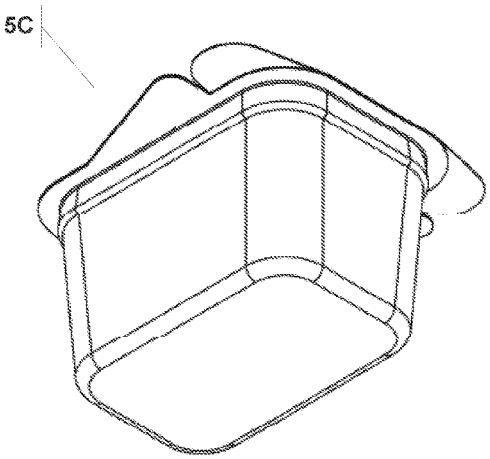
FIG. 2C illustrates a bottom perspective view of the third embodiment shown in FIG. 1C.
Figure 2D:
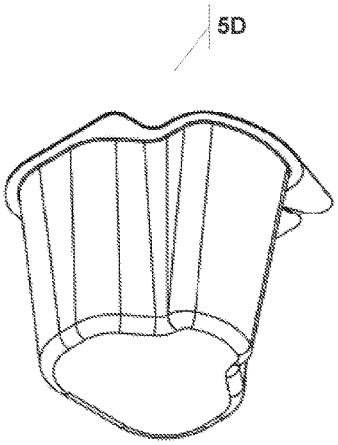
FIG. 2D illustrates a bottom perspective view of the fourth embodiment shown in FIG. 1D.
Figure 3A:
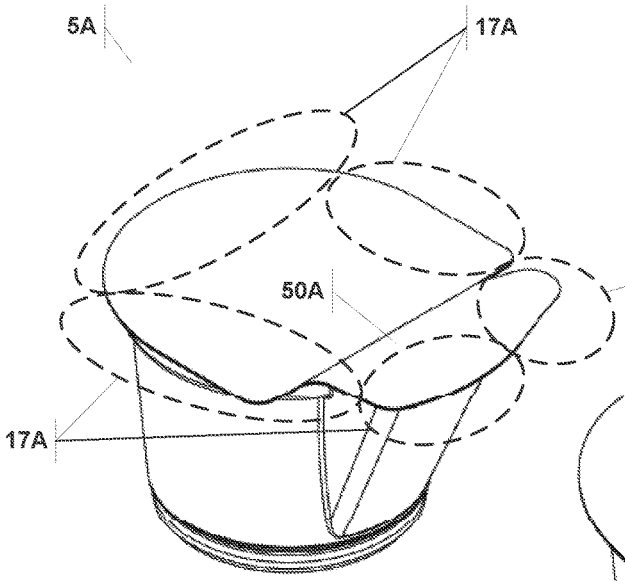
FIG. 3A illustrates the first embodiment shown in FIG. 1A a with score line.
Figure 3B:
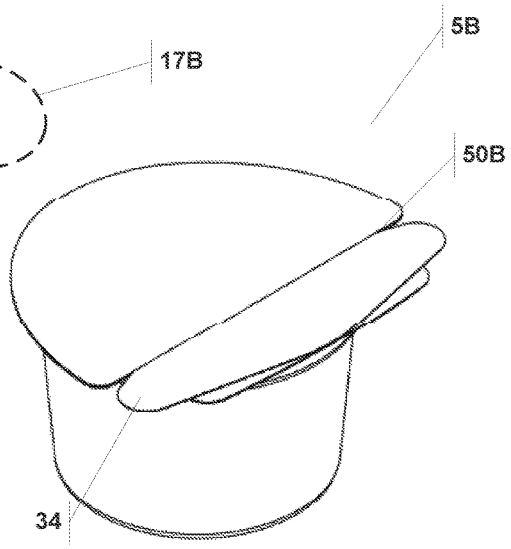
FIG. 3B illustrates the second embodiment shown in FIG. 1B with a score line.
Figure 3C:
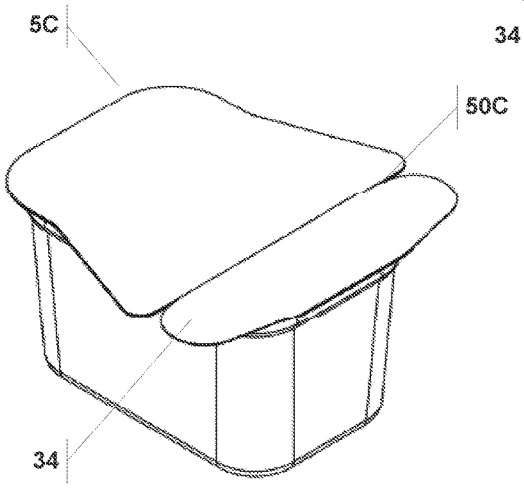
FIG. 3C illustrates the third embodiment shown in FIG. 1C with a score line.
Figure 3D:
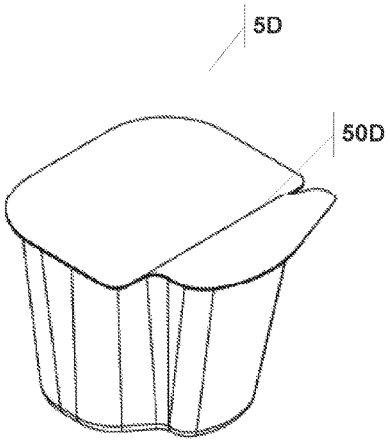
FIG. 3D illustrates the fourth embodiment shown in FIG. 1D with a score line.
Figure 4A:
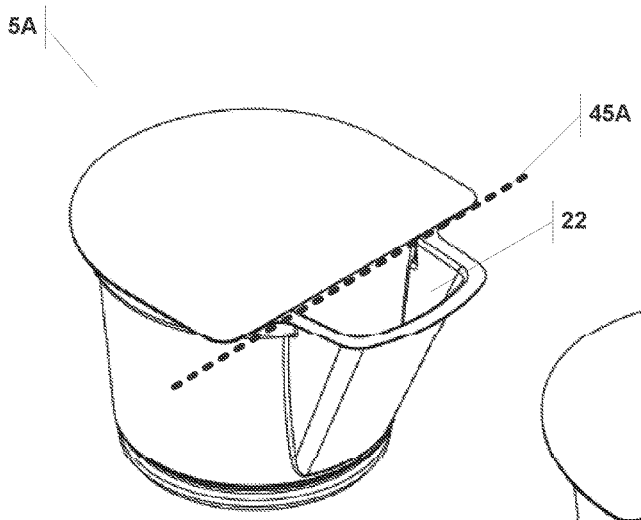
FIG. 4A illustrates the first embodiment shown in FIG. 1A with the seal-on cover removed along the tear path of the score line.
Figure 4B:
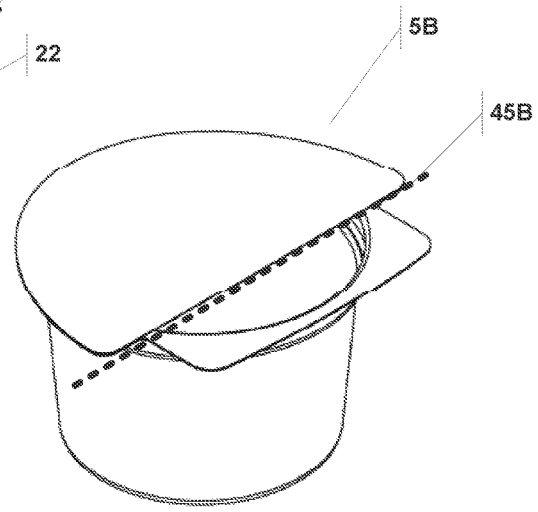
FIG. 4B illustrates the second embodiment shown in FIG. 1B with the seal-on cover removed along the tear path of the score line.
Figure 4C:
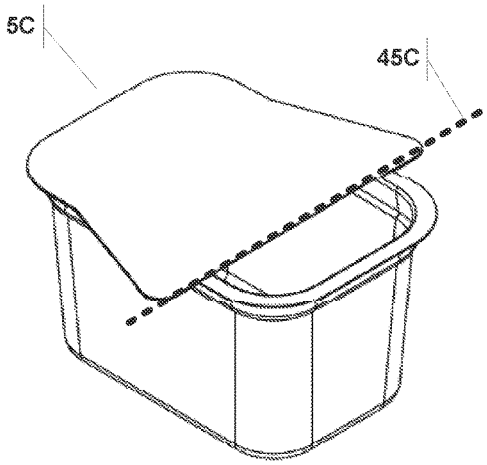
FIG. 4C illustrates the third embodiment shown in FIG. 1C with the seal-on cover removed along the tear path of the score line.
Figure 4D:
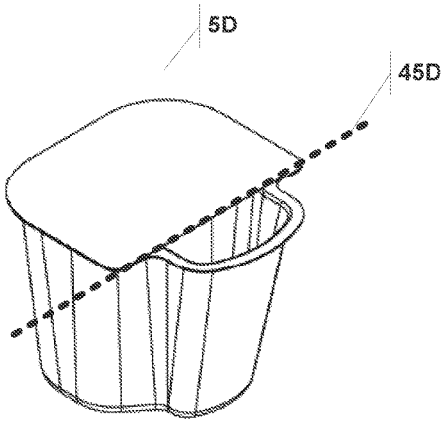
FIG. 4D illustrates the fourth embodiment shown in FIG. 1D with the seal-on cover removed along the tear path of the score line.
Figure 5A:
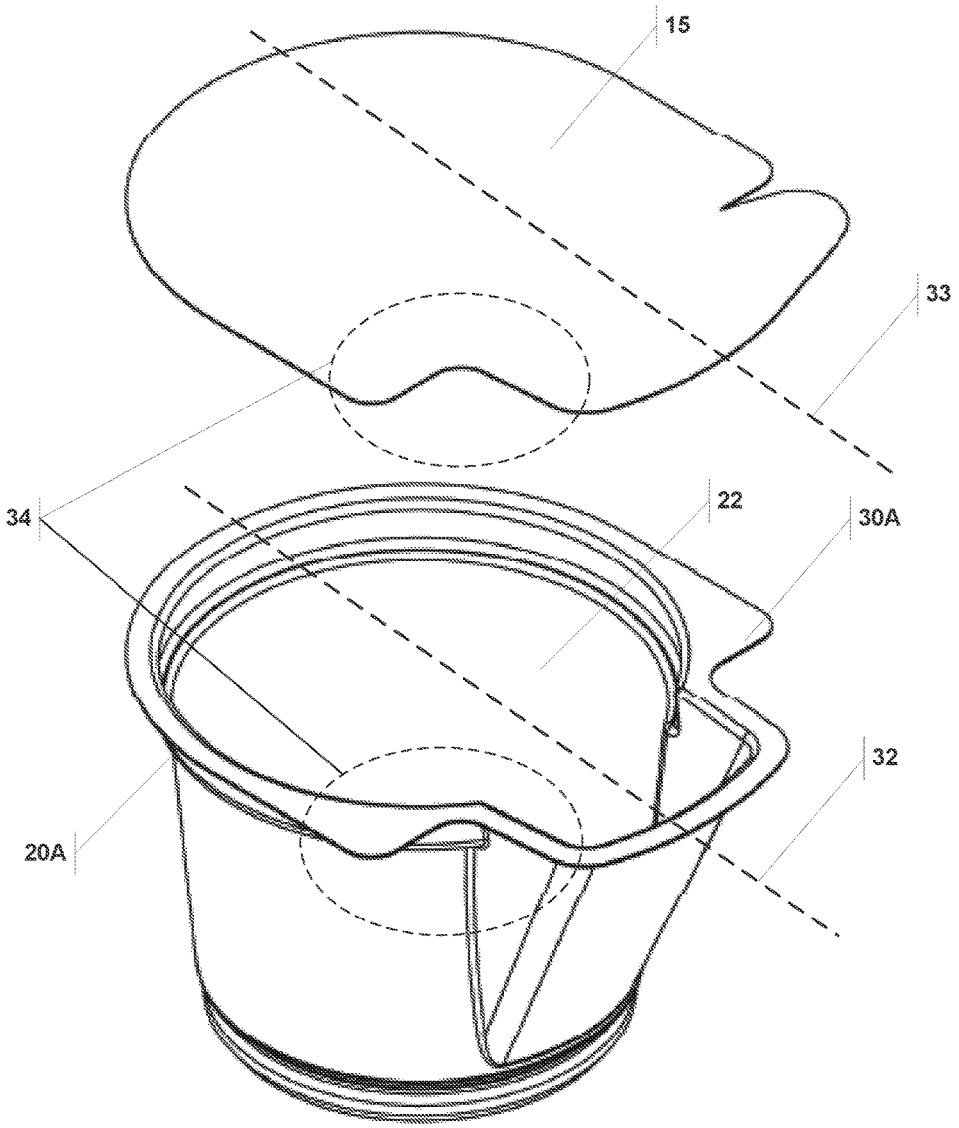
FIG. 5A illustrates a top perspective view of the first embodiment with the seal-on cover detached so the entire structure of the food container can be seen.
Figure 5B:
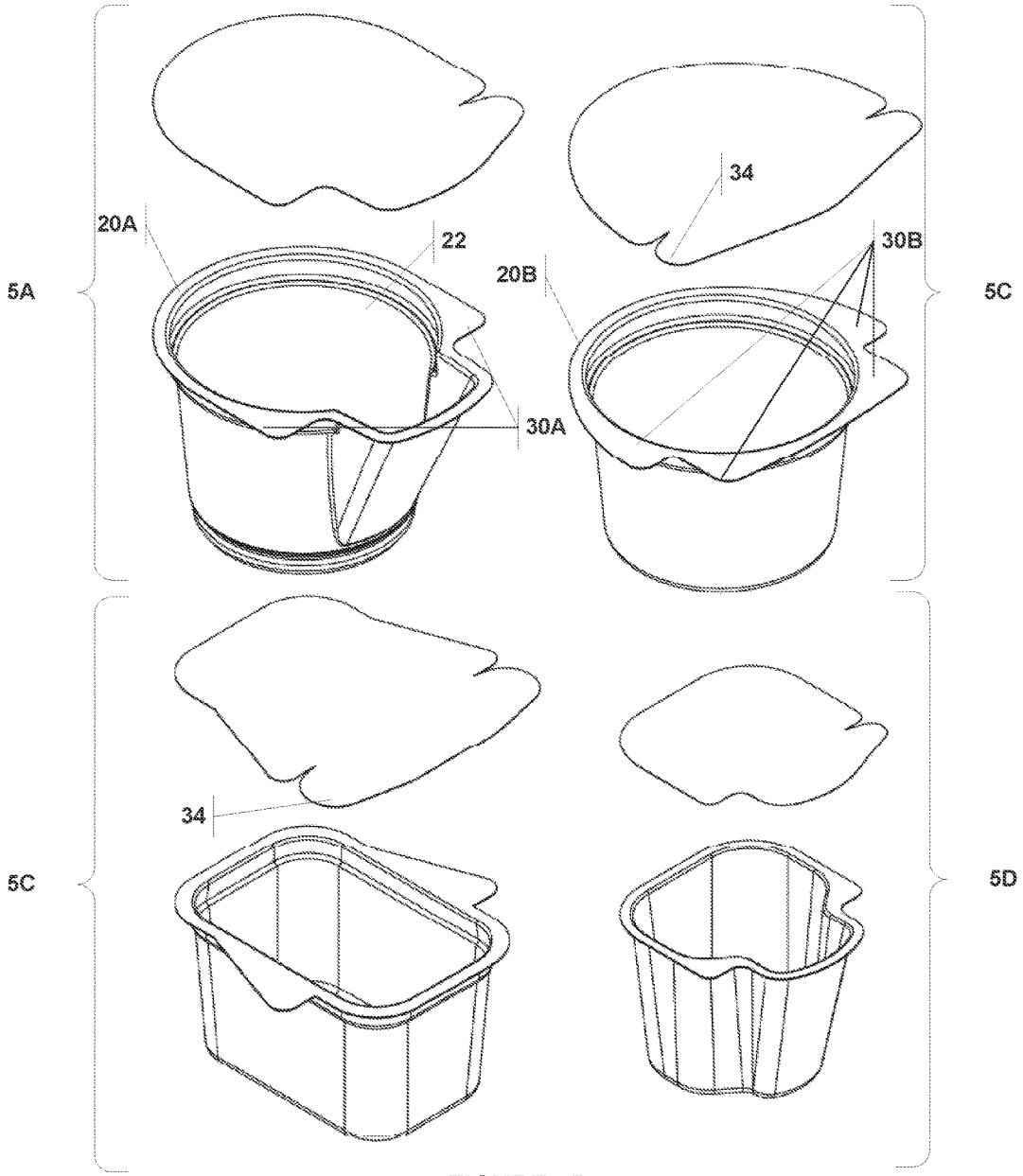
FIG. 5B illustrates a top perspective view of the first, second third and fourth embodiments with the seal-on covers detached so the entire structure of the food containers can be seen.

FIG. 2A shows that the rim of the food container 20A circumscribes a volume 22 (see FIGS. 4A, 5A and 5B). FIGS. 2A, 5A and 5B show the extended tear tab guides 30A that guide the user where to tear off a portion of the seal-on cover 15 at a particular location where the seal-on cover 15 overhangs 25A giving access to a portion of the food compartment volume 22. Furthermore, the one or more extended tear tab guides 30A guide the user for tearing the tab in the direction shown by arrow 40A, which can be seen more clearly in FIG. 1A. Once the user begins to tear in the direction of arrow 40A, the seal-on cover 15 will continue to tear along the line 45A (FIG. 4A). This tear line 45A is enhanced because the seal-on cover 15 has a peripheral edge with two portions: the first portion 17A (FIG. 3A) is adhered by adhesive, heat treatment or other suitable means to the rim 20A, and the second portion 17B (FIG. 3A) is not adhered to the rim 20A because it forms the overhang 25A that extends past the rim 20A to a sufficient extent to allow a user to pull on it. The first portion of the peripheral edge 17A may slightly overhang as well, but that overhang would not be of a sufficient extent to allow a user to pull on it. Preferably, as shown in FIG. 2A and in FIG. 5A, the shape of the rim 20A at location 30A runs parallel to the direction of the tear line 45A, which forms the overhang 25A and guides the user to tear along the direction of the tear line 45A, exposing a portion of the food compartment volume 22. Because the tear line 45A crosses the top of the food compartment 12, only a portion of the volume 22 will be exposed. This is advantageous because the user may access the contents from the food compartment 12 through a pouring action without spilling the contents. FIGS. 4A-4D illustrate how only a portion of the seal-on cover 15 is removed, exposing a portion of the volume 22.

The food compartment 12 for the first embodiment 5A is symmetrical about food compartment symmetry axis 32, while the seal-on cover 15 is not. This yields only one location where the user can tear off a portion of the seal-on cover 15. If the seal-on cover 15 is made symmetrical about the cover symmetry axis 33, then the user could have a second location/overhang 34 from which to begin tearing open the cover 15. To further assist in guiding the user to tear along the intended tear line, a score line 50A may be used.

Score lines are also shown as 50A, 50B, 50C and 50D in FIGS. 3A-3D that correspond to first, second, third and fourth embodiments, respectively. Further, the user is guided to tear along tear lines 45A, 45B, 45C or 45D shown in FIGS. 4A-4D, which correspond to first, second, third and fourth embodiments, respectively.

FIGS. 1B, 2B, 3B, 4B and 5B, illustrate a second embodiment of the food container 5B where an extended tear tab guide or guides 30B are located adjacent to the food container rim 20B and work together with the seal-on cover 15 to guide the user into tearing the seal-on cover 15 along the intended tear line 45B. Specifically, in FIGS. 1B and 2B the rim 20B extends outward and forms additional tear tab guides that are adjacent to the seal-on cover overhang 30BB and guide the user where to pull on the overhang 25B in the direction shown by arrow 40B. The seal-on cover 15 also has a notch 55 that directs the tear of the cover 15 in the direction of arrow 40B. It is the combination of the tear tab guides 30B (FIG. 2B) and the strategic location of the seal-on cover overhang 25B and the notch 55 that ensures the user tears along the intended tear line 45B shown in FIG. 4B. To further assist in guiding the user to tear along the intended tear line, a score line 50A-50D may be used, as shown in the various embodiments in FIGS. 3A-3D. The notch 55 may be at a terminal end of the score line, further assisting the user in tearing the cover along the tear line. The third and fourth embodiments shown in FIGS. 1C-1D, 2C-2D, 3C-3D, 4C-4D and 5B are similar to the ones just described with reference to the first and second embodiments, i.e., food container 5A and 5B.

The first embodiment 5A allows the user to tear open the seal-on cover from only one location, whereas the second embodiment 5B allows the user to tear open the seal-on cover from two locations, i.e., it has a second overhang 34. Similarly, the third embodiment 5C has two tear open locations, whereas the fourth embodiment 5D has only one.

It should also be noted that the food compartments for the embodiments shown in the figures are symmetrical, although they do not have to be.

Figure 6:
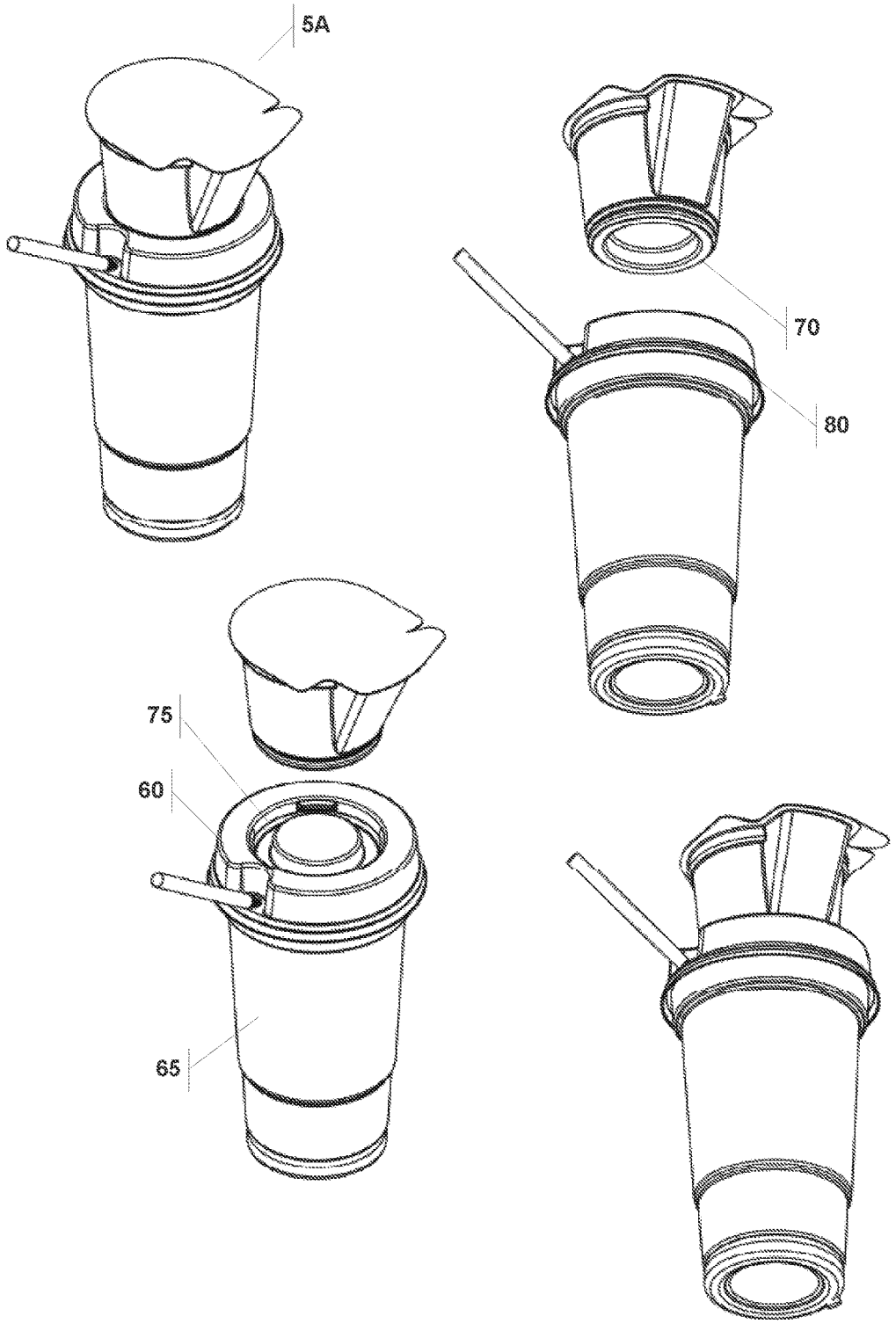
FIG. 6 illustrates the first embodiment attached and detached to a coupling lid of a beverage container.
Figure 7:
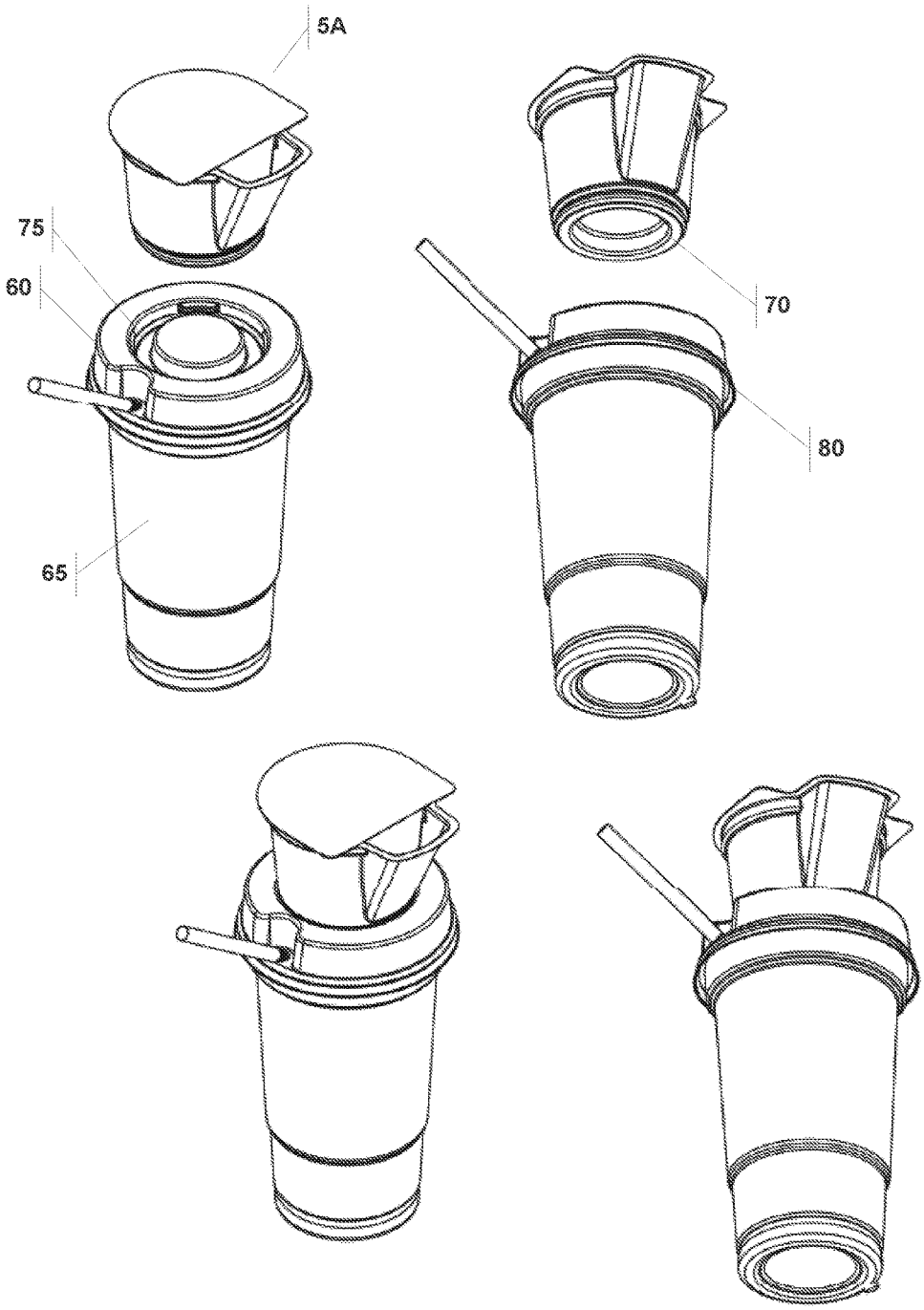
FIG. 7 illustrates the first embodiment attached and detached to a coupling lid of a beverage container, where the seal-on cover has been removed along the intended tear line.

FIGS. 6 and 7 illustrate how the food container 5A can be constructed to couple to the lid 60 of a beverage container 65. The bottom of the food container 5A may have a coupling structure 70 that detachably mates to a complementary coupling structure 75 located on the lid 60. The lid 60 may also have a beverage container coupling structure 80 that detachably mates the lid 60 to the rim of the beverage container 65. Such a lid is described in U.S. patent application Ser. No. 14/313,907 entitled "A CONTAINER LID SYSTEM WIWHT A LID PORTION AND FOOD CONTAINER PORTION" filed on Jun. 24, 2014 and U.S. patent application Ser. No. 14/986,703 entitled "CUP LID WITH INTEGRATED CONTAINER" filed on Jan. 3, 2016. Another such beverage container lid is shown in U.S. Pat. No. D767391 entitled "BEVERAGE CONTAINER LID" and issued on Sep. 27, 2016. These are by the same inventor of the present application and both are incorporated by reference here. Other examples of coupling lids are described in the patent applications listed at the beginning of this provisional application, all of which are incorporated by reference.

The food container described herein may be constructed using a variety of methods, including by non-limiting example thermoformed (thin gauge) and thin wall injection molding. The types of materials would be apparent to one of skill in the art and may include by nonlimiting example PP (polypropylene), PET (polyethylene terephthalate), CPET, RPET Polyethylene (HDPE/LDPE), styrene, HIPS, HMWPE, PP/PE blends, custom blends of thermoplastics (which may or may not include post-consumer or post-industrial content) and other proprietary blends of thermoplastics.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

The invention claimed is:

1. A food container comprising:

a food compartment comprising an outer rim circumscribing a volume;

a seal-on cover with a peripheral edge with two portions, the first portion is connected to the rim and the second portion is not connected to the rim and extends past the outer rim forming an overhang;

the food compartment further comprising at least one or more tear tab guides adjacent to the overhang that extend away from the food compartment rim parallel to a tear line in the cover, the tear line beginning at the overhang and extending to an opposite side of the peripheral edge, and the tear tab guides providing visual and tactile indication of the beginning of the tear line; and wherein when a user pulls on the overhang, the seal-on cover tears along the tear line and exposes a portion of the volume.

2. The food container of claim 1, wherein the food compartment comprises a food compartment symmetry axis and the food compartment is symmetrical about this axis.

3. The food container of claim 1, wherein the seal-on cover comprises a cover symmetry axis and the seal-on cover is symmetrical about this axis.

4. The food container of claim 1, wherein the first portion is connected to the rim by an adhesive or heat treatment.

5. The food container of claim 1, wherein the peripheral edge of the seal-on cover has a third portion that is not connected to the rim and extends past the outer rim forming a second overhang, wherein the tear line extends from the overhang to the second overhang, and wherein when a user pulls on the overhang or the second overhang, the seal-on cover tears along the tear line and exposes a portion of the volume.

6. The food container of claim 1, wherein the food compartment comprises a food container coupling structure adapted to be detachably connected to a lid complementary coupling structure.

7. The food container of claim 1, wherein the food compartment comprises a pour spout.

8. The food container of claim 1, wherein the seal-on cover comprises a notch adjacent to the overhang.

9. The food container of claim 1, wherein the seal-on cover comprises a score line.

10. The food container of claim 1, wherein an edge of the one or more tear tab guides that is adjacent to the overhang is parallel to the tear line.

11. A food container/beverage lid comprising:

a food compartment comprising an outer rim circumscribing a volume, and a food container coupling structure;

a seal-on cover with a peripheral edge with two portions, the first portion is connected to the rim and the second portion is not connected to the rim and extends past the outer rim forming an overhang;

the food compartment further comprising at least one or more tear tab guides adjacent to the overhang that extend away from the food compartment rim parallel to a tear line in the cover, the tear line beginning at the overhang and extending to an opposite side of the peripheral edge, and the tear tab guides providing visual and tactile indication of the beginning of the tear line;

wherein when a user pulls on the overhang, the seal-on cover tears along the tear line and exposes a portion of the volume; and a beverage container lid comprising a lid complementary coupling structure adapted to be detachably connected to the food container coupling structure, further comprising a beverage container coupling structure adapted to be detachably connected to a rim of a beverage container.

12. The food container/beverage lid of claim 11, wherein the food compartment comprises a food compartment symmetry axis and the food compartment is symmetrical about this axis.

13. The food container/beverage lid of claim 11, wherein the seal-on cover comprises a cover symmetry axis and the seal-on cover is symmetrical about this axis.

14. The food container/beverage lid of claim 11, wherein the first portion is connected to the rim by an adhesive or heat treatment.

15. The food container/beverage lid of claim 11, wherein the peripheral edge of the seal-on cover has a third portion that is not connected to the rim and extends past the outer rim forming a second overhang, wherein the tear line extends from the overhang to the second overhang, and wherein when a user pulls on the overhang or the second overhang, the seal-on cover tears along the tear line and exposes a portion of the volume.

16. The food container/beverage lid of claim 11, wherein the food compartment comprises a pour spout.

17. The food container/beverage lid of claim 11, wherein the seal-on cover comprises a notch adjacent to the overhang.

18. The food container/beverage lid of claim 11, wherein the seal-on cover comprises a score line.

19. The food container/beverage lid of claim 11, wherein an edge of the one or more tear tab guides that is adjacent to the overhang is parallel to the tear line.

* * * * *